United States Patent [19]

Marsh et al.

[11] Patent Number: 4,811,926

[45] Date of Patent: Mar. 14, 1989

[54] PANEL RETAINING APPARATUS

[76] Inventors: Thomas R. Marsh, Box 273, Wallburg, N.C. 27373; Raymond Saunders, Rte. #1, Draper, Va. 24324

[21] Appl. No.: 929,720

[22] Filed: Nov. 12, 1986 (Under 37 CFR 1.47)

[51] Int. Cl.[4] ..... A47G 1/10

[52] U.S. Cl. ..... 248/488; 248/345.1; 24/290

[58] Field of Search .....248/488, 140, 345.1; 312/140; 24/289, 290, 297

[56] References Cited

U.S. PATENT DOCUMENTS

| | | | |
|---|---|---|---|
| 1,608,401 | 11/1926 | Kress | 312/140 X |
| 3,377,042 | 4/1968 | Breeding et al. | 248/488 X |
| 3,478,997 | 11/1969 | Goss | 248/488 |
| 3,582,614 | 6/1971 | Zellers | 248/488 X |
| 3,633,790 | 1/1972 | Voss | 312/140 X |

FOREIGN PATENT DOCUMENTS

| | | | |
|---|---|---|---|
| 1351215 | 12/1903 | France | 248/488 |
| 403702 | 1/1934 | United Kingdom | 312/140 |

OTHER PUBLICATIONS

Alpha Technical Data, PVC Extrusion and Molding Compounds.

Ferro Corp., Product Bulletin 10120.

Panel Retaining Members Models AC, AD, AE, and AF.

*Primary Examiner*—Alvin C. Chin-Shue

*Attorney, Agent, or Firm*—Walter L. Beavers

[57] ABSTRACT

A retaining apparatus is provided for mounting glass panels within the cabinet frame such as china cabinet doors or the like. The retaining apparatus contains an insert which is resilient and provides a cushion effect to the glass panels which may be subject to sudden impacts during shipping and handling. The insert can be removed and replaced by a thicker or thinner insert as needed.

5 Claims, 1 Drawing Sheet

PANEL RETAINING APPARATUS

BACKGROUND OF THE INVENTION

1. Field of the Invention

Retaining apparatus is described herein which is useful in china cabinets and other furniture requiring panels of glass or otherwise to be held in place along their edges against the frames.

2. Description of the Prior Art and Objectives of the Invention

Various retaining devices have been developed for holding panels of glass, wood and other materials in cabinet doors, picture frames and other articles of furniture. These devices are usually attached on the back a of frame and rotate into engagement with the panel to secure it to the frame. Additional tightening of the device against the frame causes additional pressure to be applied to the panel maintaining it in a stable position. Such prior art devices are usually constructed of a rigid material which works satisfactory on certain furniture however rigid securement of glass panels in china cabinets has been proven to be unsatisfactory and oftentimes manufacturers have to repair or replace the glass panels due to breakage during handling and shipping. In many instances furniture manufacturers have had to reship furniture due to complaints from customers who have found one or more glass panels broken when the furniture arrives at their stores, even though the retainers are securely in place.

With this background in mind the present invention was developed and one of its objectives is to provide retaining apparatus which is inexpensive to manufacture and which will securely hold glass or other panels within a frame in a convenient manner.

It is another objective of the present invention to provide retaining apparatus for a panel in a cabinet or otherwise which is easy to install and which will provide a shock absorbing effect to the glass panel even if the cabinet or other furniture articles are dropped, struck or otherwise subjected to harsh handling.

It is yet another objective of the present invention to provide retaining apparatus which has a rigid base and a relatively resilient insert, said insert being removable and exchangeable for inserts of various thickness and sizes.

Other objectives and advantages of the present invention become apparent to those skilled in the art as a more detailed explanation of the retaining apparatus is presented below.

SUMMARY OF THE INVENTION

The present invention comprises retaining apparatus for holding a panel of glass or the like within a frame such as a door frame of a china cabinet. The retaining apparatus includes a base formed from a rigid material such as an approximate 10–20% fiberglass filled polyethylene composition. The base includes an upper mounting port for receiving a woodscrew or other fastener and the lower portion includes a tab receptacle for assembly with an insert. The insert is formed from a resilient polyvinyl chloride (PVC) composition with a durometer reading on the Shore A scale, 10 sec. of from 65 to 85 and has a relatively wide face for contacting the glass panel. In use, if the china cabinet is dropped or receives other impact forces during handling, the PVC insert provides a cushioning effect for the glass panel thereby preventing breakage and damage to the glass and cabinet.

DESCRIPTION OF THE PREFERRED EMBODIMENT

The preferred form of the invention comprises a retaining apparatus having a rigid base made from a 10% fiberglass filled polyethylene having a mounting port in one portion of the base for attachment to a cabinet door frame or the like. The other portion of the base includes a tab receptacle for use in receiving a tab insert. The insert is preferably formed from a resilient material such as a formulated polyvinyl chloride composition which has a durometer reading on the Shore A scale, 10 sec. of 85 and is very pliable as compared to the base. The insert includes a substantially flat face for contacting a glass panel to hold and prevent damage to the panel during shipment or storage of the cabinet.

DETAILED DESCRIPTION OF THE DRAWINGS AND OPERATION OF THE INVENTION

Figure 1:
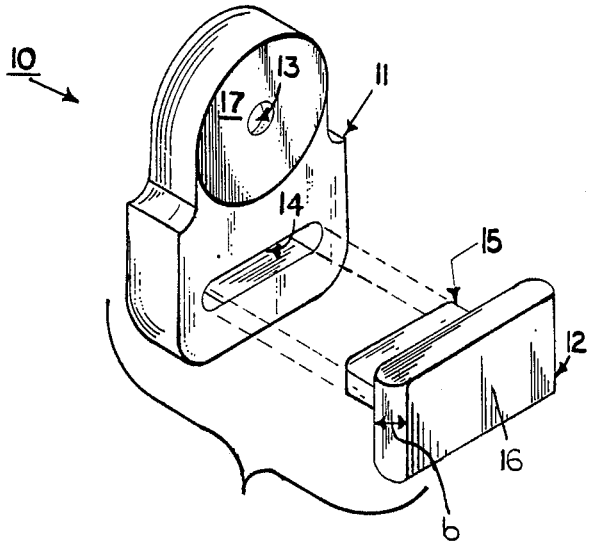
FIG. 1 is a front perspective view of the retaining apparatus of the invention shown with the insert face removed therefrom.

Turning now to the drawings, FIG. 1 illustrates in exploded fashion retaining apparatus 10 and includes base 11 and insert 12. Base 11 may be formed from an approximate 10–20% fiberglass filled polyethylene or may be molded or shaped from other materials including other suitable plastics or metals. Base 11 defines mounting port 13 and tab receptacle 14 and base 11 may for example be approximately ¾ inch in height and ½ inch wide with mounting port 13 having a diameter of ⅛ inch with tab receptacle 14 being approximately ⅛ inch high and ⅜ of an inch wide with a depth of approximately ⅛ inch. Base 11 may have an overall thickness of approximately 3/16 of an inch. Insert 12 may be formed from a suitably formulated PVC composition such as ALPHA 3006 PVC compound as sold by Alpha Chemicals And Plastics of Newark, N.J. and having the following specifications:

| | | ASTM # |
|---|---|---|
| Durometer, Shore A (±3), 10 sec. | 85 | D-2240 |
| Specific Gravity (±.02) | 1.24 | D-792 |
| Tensile Strength, psi | 2150 | D-412 |
| Ultimate Elongation, % | 275 | D-412 |
| 100% Modulus, psi | 1275 | D-412 |

Insert 12 is resilient in order to provide shock absorbing qualities for glass or other panels which it contacts. Width (b) of insert 12 may be for example ⅛ inch and it is envisioned that inserts of various widths will be provided to cabinet manufacturers in 1/16 inch increments to accommodate various frame and glass panel dimensions.

Figure 2:
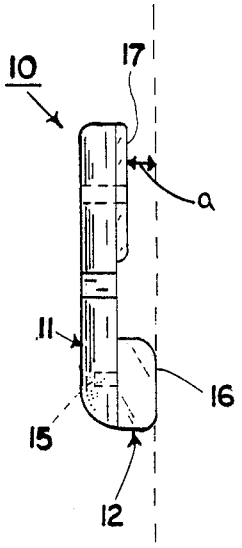
FIG. 2 demonstrates a side elevational view of the retaining apparatus as shown in FIG. 1.
Figure 3:
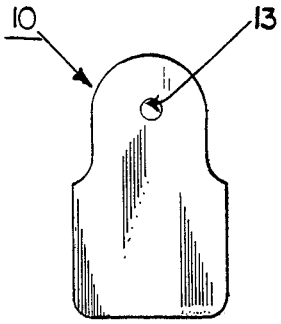
FIG. 3 illustrates the retaining apparatus as a rear elevational view.

In FIG. 2 retaining apparatus 10 is assembled with insert 12 attached to base 11 with insert tab 15 nestled within tab receptacle 14. As further shown in FIG. 2 face 16 of insert 12 extends a distance (a) forward of base front 17. The extension of insert 12 forward accommodates for differences in glass and frane depths as shown in FIG. 4 and as earlier explained different thicknesses of insert 12 are useful to furniture designers.

Figure 4:
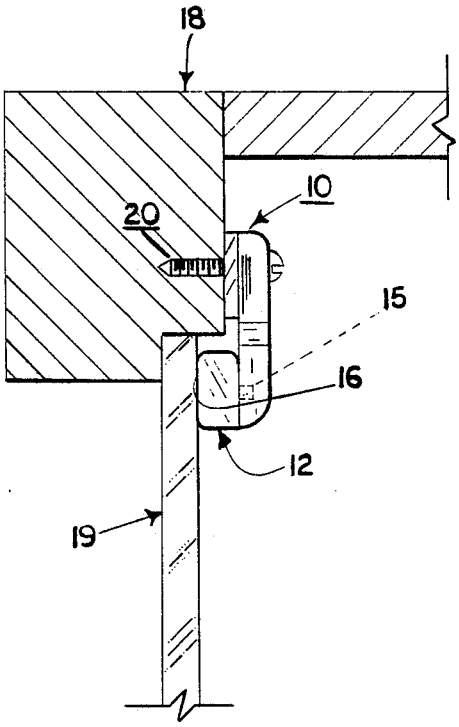
FIG. 4 is an illustration of the retaining apparatus as may be used in a china cabinet door.

As further shown in FIG. 4 cabinet frame 18 is notched to accommodate glass panel 19. Retaining apparatus 10 includes insert 12 which contacts panel 19 across insert face 16 and provides shock and impact resistance for panel 19. As also seen in FIG. 4, securing means 20 is positioned in mounting port 13 and as retaining apparatus 10 is tightened by securing means 20 onto cabinet frame 18 there is no danger of panel 19 breaking due to the resiliency of insert 12. Cabinet frame 18 may be for example a portion of a china cabinet door although retaining apparatus 10 can be used for other furniture and articles.

Changes and modifications can be made to the retaining apparatus as illustrated herein and the illustrations and explanations provided are for explanatory purposes and not intended to limit the scope of the appended claims.

We claim:

1. In combination, a pendant-like retaining apparatus having interchangeable inserts of various thickness; securing a glass panel within a frame comprising: a base, said base formed from a rigid material, said base defining a mounting port, said base having an upper disk-shaped protrusion on a front face thereof, said base having a lower rectangular tab receptacle, each insert having a flat face and a rectangular tab extending rearwardly of said flat face for positioning within said tab receptacle, said inserts formed from a resilient material, said base being firmly attached to the frame with the disk-shaped protrusion in contact with said frame; a securing means positioned within said mounting port and with one of said insert protruding in a same direction as said disk-shaped protrusion at a greater distance from said front face than the disk-shaped protrusion, and in contact with the glass panel, whereby pressure can be applied to the glass panel by the insert by tightening the securing means.

2. A pendant-like retaining apparatus as claimed in claim 1 wherein said base is formed from glass filled polyethylene.

3. A pendant-like retaining apparatus as claimed in claim 1 wherein said insert is formed from PVC.

4. A pendant-like retaining apparatus as claimed in claim 1 wherein disk-shaped protrusion defines a central mounting port coincidental with the mounting port defined by said base.

5. A pendant-like retaining apparatus as claimed in claim 1 wherein the depth of said receptacle is less than the depth of said base.

* * * * *